United States Patent [19]

Laakso

[11] Patent Number: 4,620,270

[45] Date of Patent: Oct. 28, 1986

[54] DECORATIVE SIMULATED TREE LIGHTING APPARATUS

[76] Inventor: John K. Laakso, 3456 Fairview Court, Kennesaw, Ga. 30144

[21] Appl. No.: 745,864

[22] Filed: Jun. 17, 1985

[51] Int. Cl.[4] ..... A47G 33/06

[52] U.S. Cl. ..... 362/123; 362/419

[58] Field of Search ..... 362/123, 419, 430, 249, 362/250, 252, 285, 287, 808, 806; 248/328

[56] References Cited

U.S. PATENT DOCUMENTS

| | | | |
|---|---|---|---|
| 1,579,649 | 6/1925 | Cushway | 362/123 |
| 1,778,597 | 10/1930 | Herzog | 362/123 |
| 2,806,938 | 9/1957 | Henry | 362/123 |
| 3,096,943 | 10/1961 | Forrer | 362/123 |
| 3,674,612 | 7/1972 | Gehl, Jr. | 362/123 |
| 3,704,366 | 11/1972 | Korb et al. | 362/123 |
| 3,723,723 | 3/1973 | Lerner | 362/123 |
| 3,770,951 | 11/1973 | Corelli et al. | 362/123 |
| 3,819,459 | 6/1974 | Wren | 362/123 |
| 4,404,621 | 9/1983 | Mauro | 362/123 |

*Primary Examiner*—Raymond A. Nelli

*Attorney, Agent, or Firm*—Harness, Dickey & Pierce

[57] ABSTRACT

A decorative Christmas tree lighting apparatus to simplify the decoration of Christmas trees. The apparatus may be used with or without a tree and will give the appearance of a decoratively lit Christmas tree. The apparatus may be free standing, supported by a building or supported by a tree. The apparatus provides a variety of decorative assemblies including a tree skirt.

17 Claims, 5 Drawing Figures

21
20
17
35
19
15
18
14
16
12
13
10
14
16
30
19
24
26
13
23
22
33
22
28
39
32
36
30
23
37
38
34

92
90
94
94
98
98
96
98

DECORATIVE SIMULATED TREE LIGHTING APPARATUS

BACKGROUND OF THE INVENTION AND PRIOR ART

The present invention involves an apparatus for providing the appearance of a decoratively lit cone-shaped tree. It is particularly useful for providing an outdoor decorative Christmas tree in a relatively simple and inexpensive manner. The invention may also be used to provide a variety of decorative arrangements of lights.

Each Christmas season, many people are faced with task of stringing lights on trees, whether natural or artificial, whether indoors or out. Typical efforts involve wrapping an extended length of lights around the tree in inverted spiral fashion. Most methods involve utilizing the branches of the tree as support for the lights, which, in turn, involves attaching the string of lights to the branches in some way. Since the most commonly decorated tree is the evergreen, this process is often painful, difficult and time consuming.

There are several devices known in the art which simplify to some extent this process of decorating trees. A common approach is to provide a central electrical connection for discrete sets of lights which are then supported along the length of the Christmas tree. Where the central connection is located at the top of the Christmas tree, the discrete strings of lights may be merely draped along the length of the Christmas tree. Another apparatus disclosed provides a "net" of lights which may be wrapped around the Christmas tree. In each of these devices, however,the Christmas tree branches provide support for each of the strings of lights utilizd. This still requires the actual placement of the lights in the tree and the removal therefrom when the decorative lighting is to be removed.

Outdoor lighting displays are often desired in urban settings, such as in shopping centers or in office buildings, where natural trees do not occur. Lighting decoration is often effected by importing a cut natural tree or an artificial tree, by decorating other objects with strings of lights, or by creating an independent display of lights. In addition to the problems discussed above, such displays require additional time and effort in providing the supports to be used and in creating the decorative designs.

An object of the present invention is to provide an apparatus to simplify the decoration of Christmas trees.

Another objective of the present invention is to provide a decorative light display structure whereby each of a plurality of strings of lights may be linearly displayed in a variety of patterns.

A further objective of the present invention is to provide a decorative light display structure which will simulate the appearance of a decoratively lit tree.

Still another objective is to provide a decorative light support apparatus which may be permanently mounted.

SUMMARY OF THE INVENTION

In accordance with objectives herein stated, the invention includes an elevated central hub radially surrounded by brackets anchored into a display surface. The hub may be supported on the top of a Christmas tree, on a surrounding structure such as a building, or on the top of a support designed in accordance with this invention. Strings of lights are suspensionly supported between the hub and the radially surrounding brackets such that the strings of lights are linearly displayed.

The hub and brackets may be permanently mounted, or may be designed to be quickly positioned and secured. The lights are releasably connectable to the hub and brackets so that they may easily be removed to be stored. In this fashion, creating a lighting display only involves connecting strings of lights between the brackets and hub and plugging the lights in.

One embodiment of the present invention is particularly suited to ease the ritual of decorating a Christmas tree. A collar may be placed at the top of the tree, supported by the branches or the stem of the tree, or a hub may be supported by a central pole extending through the center of the tree along the side of the trunk. Lower brackets are provided which are anchored relative to the collar or hub, through one of a variety of possible methods. For use outdoors, individual brackets or a base containing brackets may be anchored in the ground in a stake-like fashion. For use on other surfaces, such as concrete, or for use indoors, other anchoring methods may be used; for example, spokes could be used to anchor the brackets or a base to the trunk of a tree, to a stand supporting the tree or to a stand supporting the hub. Once the collar or hub and the brackets or base are positioned, lights are applied to the tree by attaching one end of each of a plurality of strings of lights to the hub or collar and the other end to the brackets or base. Electricity may be provided by extending a wire connected to a power source to either the hub or to the base.

Where a circular base or a circular pattern of brackets is used, lights connected from points on the hub to brackets located directly radially below will form a distinctive Christmas tree conical pattern. Variations of this pattern may be created by connecting lights between points which are not radially aligned, including the crossing of strings of lights. Additional variations may be derived from the use of one or more additional collars or hubs located beneath the top collar. Similarly, unique decoration may be added to a tree having a substantial space between its lowest branches and the base of the tree by positioning the collar just beneath the lower branches, whereby a tree "skirt" would result.

Other patterns can be created through the adjustment of the brackets or the use of a non-circular base.

The ornamentation resulting from the present invention is not confined to the decoration of trees. The decorative light patterns may be created upon the structure embodied in the present invention without the tree. Other means of support for the structure are required, such as a free standing device. The resulting appearance may be designed to simulate a decorated Christmas tree or may embody any variety of lighting patterns as described above.

A particularly useful application of the present invention is to provide a permanent structure for the rapid and simple display and removal of decorative strings of lights in a conical Christmas tree shape. This structure is particularly useful in an urban setting such as a shopping center or office complex. A permanent base containing electrical connectors is located in the floor or display surface and a central hub is attached to a wall or in the ceiling above the base. Although the base and hub would typicaly be unnoticeable, further precautions could be taken to cover them for safety and aesthetic reasons. Whenever a decorative display is needed, all that is required is that the strings of lights to be connected between the hub and the base and to be plugged into the electrical connectors within the base. Removal is similarly simple, and the storage required is minimal as only the strings of lights need be stored.

Other objects, features and advantages of the present invention will become apparent from the subsequent description and the appended claims, when taken in conjunction with the accompanying drawings.

DETAILED DESCRIPTION OF THE PREFERRED EMBODIMENTS

Figures 1, 5:
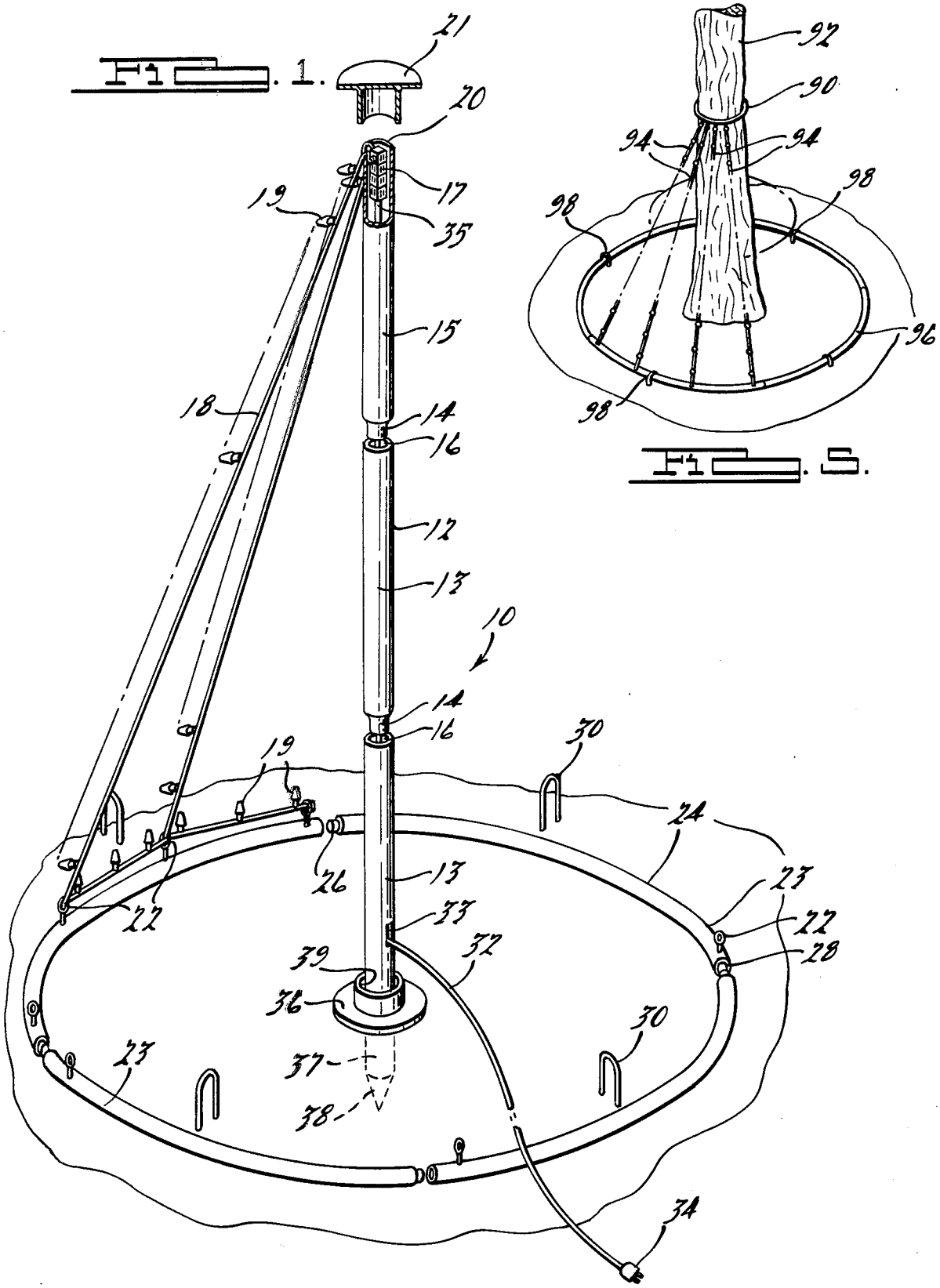
FIG. 1 is a schematic view of an apparatus for decoratively displaying strings of lights according to the present invention.
FIG. 5 is a schematic view of another embodiment of the present invention when used to decorate an existing tree.

Referring to FIG. 1, a free standing apparatus for the decorative display of strings of the lights is generally referred to at 10. The apparatus is comprised of a segmented base 24 and a segmented central support 12. The center support 12 is comprised of a series of interconnected segments 13, each segment having a tapered end 14 of a reduced diameter that is insertable into the opposing end 16 of another segment.

The base 24 has a plurality (at least two) segments 23 for easy transportation and storage. The ends 26 of the segments 23 are tapered and of a diameter such that they can be inserted into the ends 28 of adjacent segments. The base 24 is secured to the ground in the pictured embodiment of U-shaped stakes 30, but may be permanently implanted or attached to the display surface as desired. Preferably the tubular segments 13 of the center support 12 and the segments 23 of the base 24 are made of a durable and light weight material, such as aluminum tubing. Open eyelets 22 are screwed, welded, or otherwise relatively permanently connected to the base.

The center support 12 may be configured to be implantable in the ground, having a bottom end section 27. The section 37 has a pointed end 38 and a plate 36 to facilitate implantation. The plate 36 is substantially perpendicular to the implanted portion of the central support to provide stability when the support is implanted, and also acts as a step or drive plate so that force may be used to aid in implanting the pointed end 38 in the ground. A collar 39 may be provided at the juncture between the section 37 and the center support 12. The collar 34, pivotally mounted on the plate 36, allows for use of the invention on uneven slopes whereby the central support 12 can always be positioned substantially vertically.

Strings of lights 18 having a plurality of light bulbs 19 are connectable to the top segment of the center support 12. The lower ends of the strings of lights 18 are connectable to the eyelets 22 which are in turn connected to the tubular base 24. The strings of lights are fastened within each of the eyelets 22 or alternatively can be connected to the eyelets 22 by a standard clip. The eyelets also can be sufficiently large to permit the lights to pass through them so that a string of lights may be run through one eyelet and connected to the next.

An electrical cord 32 is illustrated entering the central support 12 near its base through an opening 33. The male (plug) end 34 of the cord is connected to an electrical power source (not shown) and the cord is extended through the central support 12 through the end 20 of the end segment 15 where the (plug) end of the strings of lights 18 are connected to female (socket) end 35 of the cord.

Once the lights 18 are connected to the female end 35 of the cord 32, the opposite end of the cord containing the plug 34 may be pulled, drawing the socket 35 and the plug ends 17 of the light strings 18 into the end segment 15 of the center support 12. The end segment 15 has a sufficiently large inner diameter to permit the insertion of the socket 35 containing a full compliment of plugs from the light strings 18. The tapered end 14 of the end segment 15 permits insertion into the opposing end 16 of the adjacent segment and restricts further withdrawal of the cord 32 and the socket 35 away from the end 20. A cap 21 fits over top of the end 20 of the end segment and the portions of the strings of lights extending into the end segment 15. The cap 21 protects the socket 35 from the elements, and anchors the strings of lights through a clamping action, opposing any tension in the strings. Thusly, any tension in the strings of lights is not communicated to the plugs 17 of the strings, and the electrical connection between the plugs 17 and the socket 35 is not subjected to the tension resulting from suspending the strings of lights. Alternatively, the strings of lights may be fastened to the cap 21 by standard clips as is described further herein.

The embodiment shown in FIG. 1 illustrates the use of a circular base 24 such that when the lights 18 are strung from the top of the central support 20 to the eyelet 22 on the base 24, and illuminated, a conical or "pine tree-like" appearance will result.

In this regard, the eyelets 22 and the strings of lights 18 are preferably positioned and dimensioned to create a system as shown in FIG. 1. The eyelets 22 are equidistantly positioned around the circumference of the base 24 and each of the strings of lights 18 have a length such that they extend from the upper end 20 of the central support, to a first and then a second eyelet on the base 24.

Figure 2:
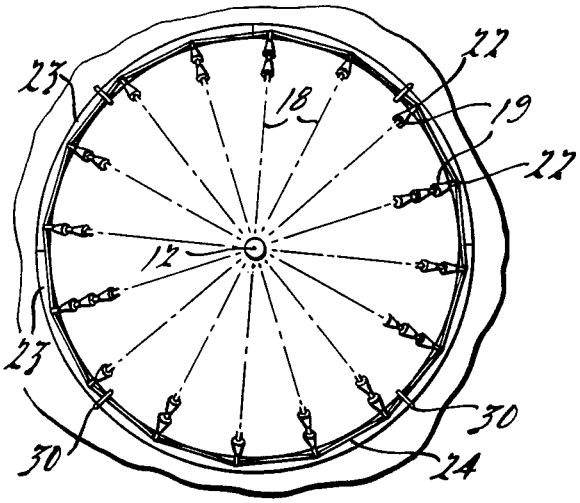
FIG. 2 is a top elevational view of the free standing version of the present invention.

FIG. 2 is a top view of the design created by the free standing structure illustrated in FIG. 1. The strings of light 18 are connected to the center central support 12 and the base 24 and extend along the base between the eyelets 22.

Figure 3:
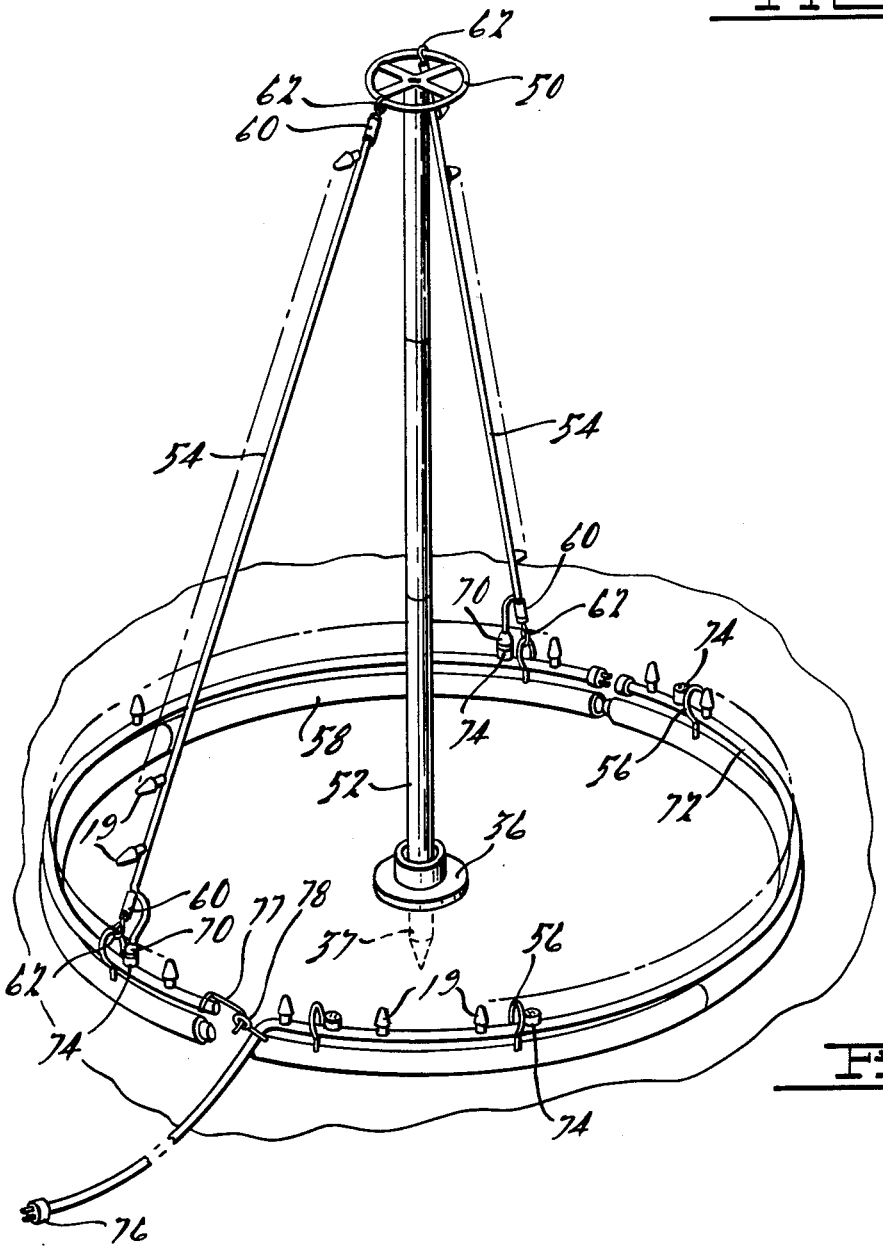
FIG. 3 is a schematic view of another embodiment of the present invention.

FIG. 3 illustrates another free-standing embodiment of the invention. A ring 50 is supported on the top of the central support 52, which is preferably segmented as previously described and also adapted to be implanted in the ground. The strings of lights 54 are releasably connected to eyelets 56 which are attached to the tubular base ring 58. Each string of lights 54 has an expandable connector 60 at each end, which may be of any elastic material, to accommodate for uneven surfaces and to assure that the string of lights is stretched tautly between the hub ring 50 and the base 58. Each expandable connector 60 has a clip 62 associated with it in order to connect the string of lights to the hub ring and the eyelet brackets. The clip 62 can be of any conventional quick-fastening type.

Each string of lights 54 has a male (plug) outlet 70 which is connectable to an electrical power source. The strings of lights are connected to the electrical power source by the base wire 72 which has a plurality of female (sockets) outlets 74 spaced at the same intervals as the eyelets 56. A male outlet 76 is provided to connect the base wire 72 to the source of electricity. The base wire 72 is directed through the eyelets 56 and provided with lights 19 to add to the decorative appearance of the assembly. A hook 77 and loop 78 are provided to maintain tension on the base wire 72.

Alternatively, the base wire 72 may be contained within, and hidden from sight by, the base 58 which is provided with slots or a groove to permit the connection of the light strings to the base wire.

In still another embodiment (not shown) the central support can be provided with spokes radially extending to the base ring, providing support for the device to be free standing on hard surfaces and at the same time anchoring the base to prevent motion relative to the central support.

Figure 4:
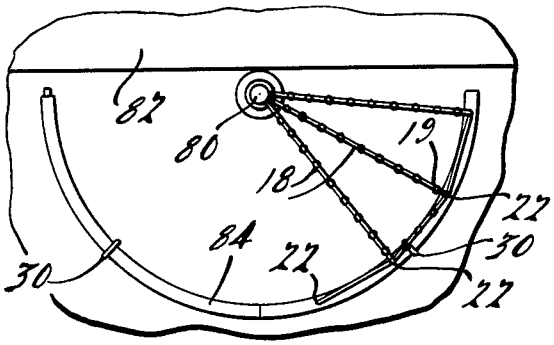
FIG. 4 is a a top elevational view of the present invention against a wall or building.

FIG. 4 illustrates the invention in use against a wall or building. The central support 80 may either be attached to the wall 82, or free-standing next to it. In essence, one-half of the structure shown in FIGS. 1 and 2 is utilized for the embodiment of FIG. 4. The base ring 84 comprises a semi-circle and is held in place on the ground by U-shaped stakes 30. One-half of the strings of lights 18 are utilized and they extend from the top of the central support 80 to the eyelets 22 and along the base ring 84 in the same manner as described above with reference to FIGS. 1 and 2.

FIG. 5 illustrates another embodiment of the present invention which is used to provide a "tree skirt". A ring or collar 90 is fastened around the trunk of a tree 92 by thumbscrews or other suitable means. Strings of lights 94 are attached to the collar 90 and extend to the base ring 96. The base ring 96 is anchored to the ground by U-shaped stakes 98. An electrical supply is connected to the strings of lights 94 by running an electrical cord to the collar 90 as described above (if the strings of lights are the same as those shown in FIGS. 1 and 2), or by running an electrical cord to the base ring 96 as described above (if the strings of lights are the same as those shown in FIG. 3).

While it will be apparent that the preferred embodiments of the invention disclosed are well calculated to fulfill the objects, benefits, or advantages of the invention, it will be appreciated that the invention is susceptible to modification, variation and change without departing from the proper scope or fair meaning of the subjoined claims.

I claim:

1. A lighting apparatus for decorating a structure comprising:

a multi-piece base member having a ring shape and positioned on a surface, means for releasably securing said base member onto said surface, central support means positioned substantially at the center of said base member and positioned and supported above said base member, at least one string of lights releasably secured to said support means and said base member, means on said base member for releasably securing said string of lights to said base member, means on said support means for releasably securing said string of lights to said support member, wherein said string of lights is suspensionally supported between said support means and base member.

2. The decorative lighting apparatus of claim 1 wherein said central support means comprises a collar enclosable about a portion of a tree, and a thumbscrew engageable into said tree for supporting said collar about said tree.

3. The decorative lighting apparatus of claim 1 wherein said means for releasably securing said base member to a surface includes brackets for releasably anchoring said brackets into the ground.

4. The decorative lighting apparatus of claim 1 wherein said multi-piece base member comprises a plurality of sections which are releasably connected together, and said central support means comprises a plurality of sections which are releasably secured together forming a hollow vertical rod member.

5. The decorative lighting apparatus of claim 1 further comprising:

an electrical cord disposed within said base member; and a plurality of female outlets connected to said electrical cord, each outlet in proximity of said means for releasably securing said string of lights to said base member.

6. The decorative lighting apparatus of claim 4 wherein said means for releasably securing said string of lights onto said central support means includes a cap positioned on the end of said segmented central support.

7. A free standing decorative lighting apparatus comprising:

a multi-piece base member having a ring shape and positioned on a surface;

means for releasably securing said base member onto said surface;

an elongated central support positioned substantially at the center of said base member and extending vertically from said surface;

at least one string of lights releasably secured to said elongated central support and base member, means on said base member for releasably securing said string of lights to said base member, means on the extending free end of said elongated central support for releasably securing said string of lights to said central support;

wherein said string of lights is suspensionally supported between said elongated central support and base member.

8. The decorative lighting apparatus of claim 7 wherein said central support has a pointed section at one end for implantation in the ground.

9. The decorative lighting apparatus of claim 8 further comprising a flange member adjacent said pointed section, said flange member adapted to be used to assist in implanting said pointed section.

10. The decorative lighting apparatus of claim 9 further comprising collar means connecting said pointed section to said central support such that said central support is pivotable about an axis defined by said pointed section.

11. The decorative lighting apparatus of claim 7 further comprising:

an electrical wire disposed within said central support;

at least one female outlet on one of said electrical wire disposed within said central support and connectable to said string of lights; and a male outlet connected on the other end of said wire opposing said female outlets.

12. The decorative lighting apparatus of claim 7 further comprising extendable connectors disposed on said string of lights for releasably connecting said string of lights to said means on the extending free end of said central support and to said means on said base member.

13. The decorative lighting apparatus of claim 7 further comprising:

an electrical wire disposed within said base member;

a plurality of female outlets connected to said wire disposed upon said base member in proximity to each of said means for releasably securing said string of lights; and a male outlet connectd to said wire.

14. The decorative lighting apparatus of claim 7 wherein means for releasably securing said string of lights on said base member includes a plurality of eyelets positioned equally about said ring shaped base member.

15. The decorative lighting apparatus of claim 7 wherein said means for releasably securing said string of lights onto said free extending end of said central support includes a cap positioned on said free extending end.

16. The decorative lighting apparatus of claim 7 wherein said means for releasably securing said string of lights onto said free extending end of said central support includes a ring positioned on said free extending end.

17. A free standing decorative lighting apparatus comprising:

a multi-piece base member comprised of elongated tubular sections releasably interconnected together to form a circular ring, brackets for releasably securing said base onto a ground surface, a segmented elongated central support position substantially at the center of said circular ring base member, a pointed segment secured to one end of said central support for implanting said central support into the ground, an implanting flange having a collar means secured to said pointed segment for improving implanting into the ground, said collar means provides a pivotable connection between said pointed segment and said central support, at least one string of lights releasably secured to said central support and said base member, a ring positioned on the other end of said central support providing a releasable securing surface for securing said string of lights to said central support, a plurality of eyelets positioned equal distance apart on said circular ring base member providing a releasable securing surface for securing said string of lights to said central support, extendable connectors associated with said string of lights for releasably securing said string of lights onto said ring and eyelets, wherein said string of lights is suspensionally supported between said ring and eyelets.

* * * * *

UNITED STATES PATENT AND TRADEMARK OFFICE

CERTIFICATE OF CORRECTION

PATENT NO. : 4,620,270

DATED : October 28, 1986

INVENTOR(S) : John K. Laakso

It is certified that error appears in the above-identified patent and that said Letters Patent is hereby corrected as shown below:

| | | |
|---|---|---|
| Column 1 line 34 | "however,the" should be --however, the--. |
| Column 1 line 36 | "utilizd" should be --utilized--. |
| Column 2, line 65 | "typicaly" should be --typically--. |
| Column 3, line 39 | "of" should be --by--. |
| Column 3, line 48 | "27" should be --37--. |
| Column 4, line 49 | "central support" should be --support--. |

UNITED STATES PATENT AND TRADEMARK OFFICE

CERTIFICATE OF CORRECTION

PATENT NO. : 4,620,270

DATED : October 28, 1986

INVENTOR(S) : John K. Laakso

It is certified that error appears in the above-identified patent and that said Letters Patent is hereby corrected as shown below:

| | | |
|---|---|---|
| Column 5, | line 65 | "member," should be --member, and --. |
| Column 6, | line 40 | "member," should be --member;--. |
| Column 6, | line 42 | "member," should be --member;--. |
| Column 6, | line 45 | "support;" should be --support; and--. |
| Column 7, | line 15 | "connectd" should be --connected--. |
| Column 8, | line 27 | "support," should be --support, and--. |

Signed and Sealed this

Twenty-fifth Day of August, 1987

*Attest:*

*Attesting Officer*

DONALD J. QUIGG

*Commissioner of Patents and Trademarks*